United States Patent [19]

Honjo et al.

[11] Patent Number: 4,738,443

[45] Date of Patent: Apr. 19, 1988

[54] SHEET HANDLING APPARATUS

[75] Inventors: Takeshi Honjo, Kawasaki; Koichi Murakami, Yokohama, both of Japan

[73] Assignee: Canon Kabushiki Kaisha, Tokyo, Japan

[21] Appl. No.: 607,623

[22] Filed: May 7, 1984

[30] Foreign Application Priority Data

May 10, 1983 [JP] Japan ..... 58-81137

[51] Int. Cl.[4] ..... B65H 39/10

[52] U.S. Cl. ..... 271/288; 271/263; 271/294

[58] Field of Search ..... 271/288, 292, 293, 294, 271/258, 259, 263

[56] References Cited

U.S. PATENT DOCUMENTS

| | | | |
|---|---|---|---|
| 3,953,023 | 4/1976 | Cross | 271/293 X |
| 4,211,483 | 7/1980 | Hannigan | 271/288 X |
| 4,337,936 | 7/1982 | Lawrence | 271/293 |
| 4,469,323 | 9/1984 | Miyashita | 271/288 |

*Primary Examiner*—Richard A. Schacher

*Attorney, Agent, or Firm*—Fitzpatrick, Cella, Harper & Scinto

[57] ABSTRACT

A sorter has trays or bins for storing sorted sheets, rollers for conveying the sheets received from a copying machine, a cam mechanism for moving the bins, and a controller including a microcomputer for properly controlling the sorting operation in different modes. With a minimum number of signals, the sorter can change the operation mode and can be turned off automatically if no sheet is received within a given time from reception of an ON signal.

20 Claims, 16 Drawing Sheets

SHEET HANDLING APPARATUS

BACKGROUND OF THE INVENTION

1. Field of the Invention

The present invention relates to a sheet handling apparatus (to be referred to as a sorter hereinafter) which performs sorting and storage of paper sheets (to be referred to as sheets hereinafter) such as copying sheets or recording paper sheets which are conveyed after images are formed thereon by an image formation apparatus or recording equipment, such as a copying machine or a printing press.

2. Description of the Prior Art

A sorter generally has 10 to 20 or more sheet storages (tray or bin group). Sheets are conveyed at predetermined intervals from an apparatus, such as a copying machine, and are sequentially fed into and stored in predetermined trays by a convey means such as a belt, a plurality of rollers or a combination thereof.

When such a sorter is used in combination with a copying machine, the sorter has a sort mode, a non sort mode, and a collate mode. In the sort mode, sheets sequentially exhausted from the copying machine are stored and stored in predetermined trays. In the non sort mode, all the sheets are stored in a predetermined or special tray. In the collate mode, sheets of the same type are stored in the same tray.

Even if the sorter operates in many such modes, the number of types of signals exchanged between the copying machine and the sorter is preferably small from the viewpoints of cost and reliability. The effects obtainable with such a reduction in the number of types of signals exchanged between the copying machine and the sorter are significant, especially in a copying machine and sorter of simple configuration.

When jamming or short supply of toner occurs in a copying machine, if a sorter connected thereto is supplied with power from the copying machine, the power of the sorter is turned off during the process of jammed sheet removal or toner replenishment. If the sorter is in the sort mode before the power is turned off, the sequence mode immediately before such a process must be restored on power resumption.

A conventional sorter is known wherein the group of trays at the exhaust port of a copying machine or the like is sequentially moved so as to perform sorting and storage of sheets.

A sorter of this type sometimes has a sheet detecting means arranged immediately before the convey means of the sorter so as to monitor sheet convey failure. The sheet detecting means comprises, for example, a lightweight element such as a combination of a reed SW (switch)and an actuator. When the sheet is conveyed, the actuator is caught by the conveyed sheet and is detected by the reed SW.

This sorter has a configuration wherein after the conveyed sheets are completely stored in trays, the tray group is moved for the next operation. For this reason, if the sorter is subject to some vibration, especially, if the operator moves the sorter to the exhaust port of the copying machine too roughly, the sheet detecting means is actuated due to its light weight. The detecting means thus produces an erroneous output indicating that the sheet has been conveyed, and the tray group is moved, presenting a danger to the operator.

In such a system as described above, electric interfacing between the sorter and the copying machine is controlled by the conversation method.

According to one known configuration, when the copy start key of the copying machine is depressed, a sorter operation start signal is supplied to the sorter. Then, the sorter moves the trays to predetermined positions. When the trays ar completely moved to the predetermined positions, the sorter supplies a sorter standby signal to the copying machine. The copying machine then starts the copying operation and the produced copy sheet is exhausted.

In the system having the configuration described above, the sorter is set in the standby mode in response to the sorter operation start signal and is kept in this mode until the copy sheet is exhausted from the copying machine. However, if the copying machine does not produce any copy sheet due to either depression of the stop key or jamming, the standby mode of the sorter must be released. This requires the use of a third signal in addition to the sorter operation start signal and the sorter standby signal, thus increasing the number of signals to be handled.

In a sorter of the type described above, the trays are generally arranged at equal intervals, and the tray interval is narrowed when the corresponding tray is to receive the conveyed sheet. After the conveyed sheet has been received in the corresponding tray, the narrow interval must be reset to the regular interval. When the sheet convey at the inlet opening of the tray is interfered with, the sheet is jammed between adjacent trays. Removal of the jammed sheet from the narrow interval between the trays is then very difficult.

SUMMARY OF THE INVENTION

The present invention has been made in consideration of this and has as its object to provide a sheet handling apparatus which has excellent operability.

It is another object of the present invention to provide a sheet handling apparatus with good reliability.

It is still another object of the present invention to provide a sheet handling apparatus having a plurality of modes wherein a suitable mode can be selected as needed.

It is still another object of the present invention to provide a sheet handling apparatus having a plurality of modes wherein the number of types of signals exchanged with an image formation apparatus is not unnecessarily increased.

It is still another object of the present invention to provide a sheet handling apparatus which allows reliable and easy sheet removal when sheet convey failure occurs.

It is still another object of the present invention to provide a sheet handling apparatus which moves a storage section when it receives the first image formation start signal in the collate mode.

It is still another object of the present invention to provide a sheet handling apparatus which returns the storage section to the home position when it receives the first image formation start signal immediately after the mode has been switched to the collate mode from any other mode.

It is still another object of the present invention to provide a sheet handling apparatus which allows easy removal of jammed sheets from the inlet of the storage section by shifting the storage section in response to a key input in a special state.

It is still another object of the present invention to provide a sheet handling apparatus which can prevent erratic operation of a sheet detecting means, when any abnormality such as jamming or insufficient toner is resolved, by restoring the normal mode a predetermined period of time after the sorter is completely located at the exhaust port of the copying machine.

It is still another object of the present invention to provide a sheet handling apparatus with a signal transmission system of minimum size which can save power since it is automatically deenergized if, for any reason, no sheet is received within a predetermined period of time since it received an operation start signal.

It is still another object of the present invention to provide a sheet handling apparatus which is safe due to the feature of self diagnosis.

The above and other objects and features of the present invention will become apparent from the following description taken in conjunction with the accompanying drawings.

DETAILED DESCRIPTION OF THE PREFERRED EMBODIMENTS

The preferred embodiment of the present invention will now be described in detail with reference to the accompanying drawings.

Figure 1:
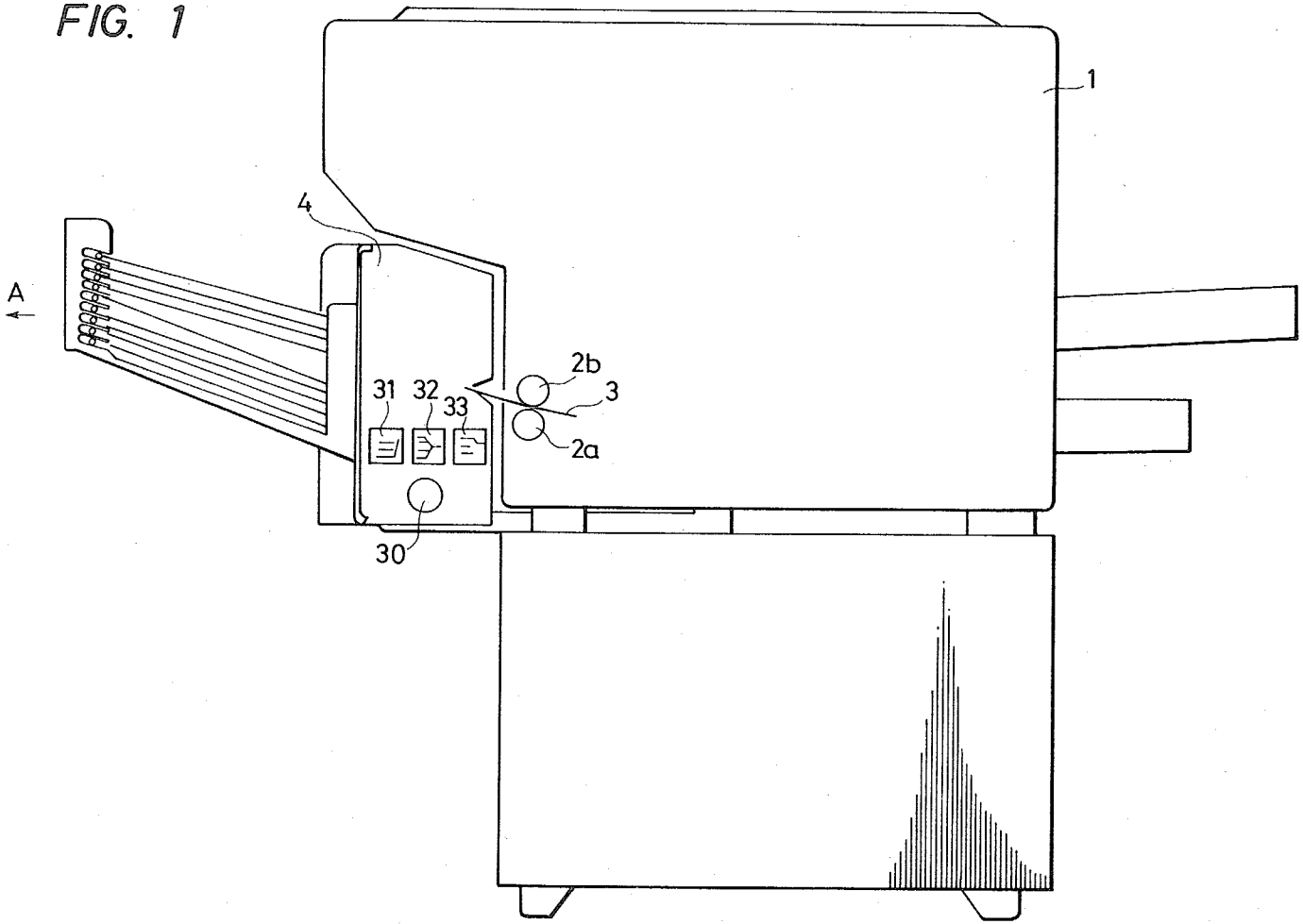
FIG. 1 is a sectional view showing an outer appearance of a sorter connected to a copying machine.

FIG. 1 is a view showing the outer appearance of a sorter according to an embodiment of the present invention connected to a copying machine. Referring to FIG. 1, a sorter 4 according to the embodiment of the present invention is connected to the exhaust port of a copying machine main body 1. A copy sheet 3 exhausted from the copying machine main body 1 is supplied to the inlet port of the sorter 4 through exhaust rollers 2*a* and 2*b* of the main body 1.

The sorter 4 has a mode selection switch 30 for selecting the mode thereof, a non sort LED 31 for displaying that the non sort mode is currently selected, a sort LED 32 for displaying that the sort mode is currently selected, and a collate LED 33 for displaying that the collate mode is currently selected. The sorter 4 is movable in the direction indicated by arrow A so as to allow easy removal of a jammed copy sheet 3.

Figure 2:
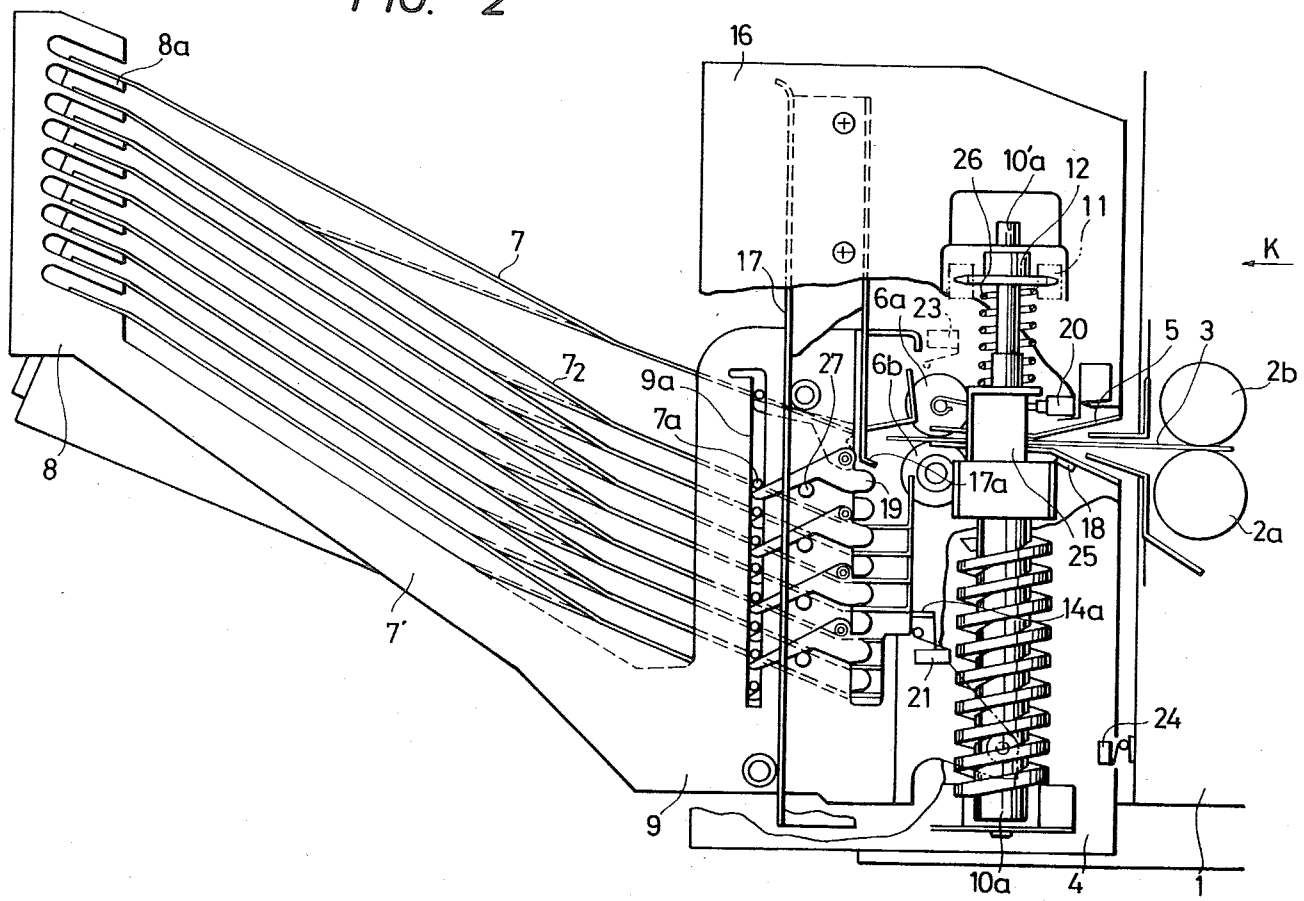
FIGS. 2 and 3 are sectional views of the sorter.

FIG. 2 is a schematic sectional view of the sorter according to the embodiment of the present invention. When the sorter 4 is arranged opposed to the copying machine main body 1 as shown in FIG. 1, a joint switch 24 is ON. When the sorter 4 is moved anywhere else, the joint switch 24 is OFF.

When the copy sheet 3 is supplied to the inlet port of the sorter 4, it is guided by a feed-in guide 5 to convey rollers 6*a* and 6*b* driven by a sheet convey motor 28 (not shown). The sheet inlet port of a tray or bin $7_2$ is arranged to oppose nip portions of the convey rollers 6*a* and 6*b*. Therefore, the copy sheet 3 which is conveyed by the convey rollers 6*a* and 6*b* is stored in the tray $7_2$. If the feed-in guide 5 is shortened, the exhaust rollers 2*a* and 2*b* of the main body 1 may also serve as the convey rollers 6*a* and 6*b*.

The ends of all the trays of a tray or bin group 7, except a lowermost tray 7', are separated from the main body 1 by a greater distance than the other ends along the sheet convey direction and are placed on engaging grooves 8*a* of a tray pivot support plate 8. Thus, the trays are movable along the sheet convey direction.

A projection 7*a* at the side of the sheet inlet port of each tray is supported by a corresponding arm member 19 so as to be vertically movable within an elongated groove 9*a* of a tray support plate 9. Each arm member 19 is mounted on the tray support plate 9 so as to be pivotal about the fulcrum thereof.

The lowermost tray 7' can be fixed on the tray pivot support plate 8 and the tray support plate 9 by screwing or spot welding. Alternatively, the lowermost tray 7' and the plates 8 and 9 can be formed integrally with each other. Thus, the lowermost tray 7' and the plates 8 and 9 together serve as a frame structure for supporting the trays.

Figure 3:
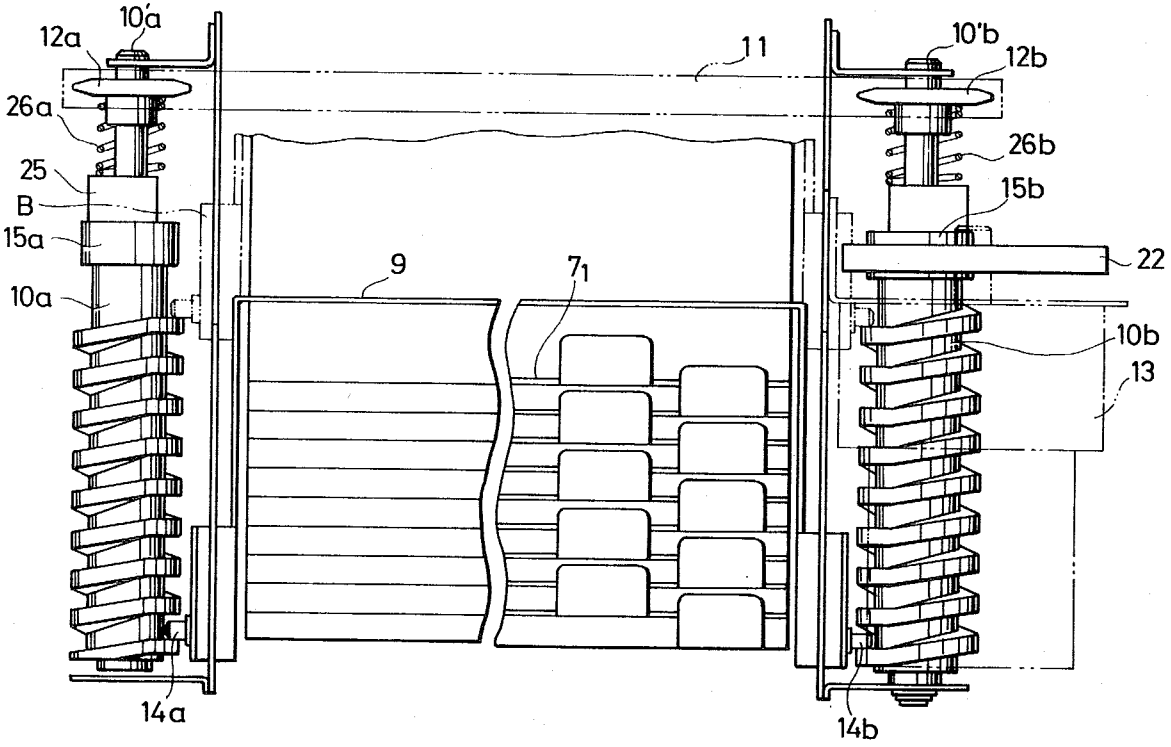

FIG. 3 is a view of the sorter viewed from the direction indicated by symbol K in the sectional view in FIG. 2. A pair of projections 14*a* and 14*b* are caulked to one end of the tray support plate 9. The projections 14*a* and 14*b* are engageable with the lead surfaces of a pair of lead cams 10*a* and 10*b*. Upon each revolution of the lead cams 10*a* and 10*b*, the trays can be moved vertically. Thus, the sheet inlet ports of the respective trays are sequentially set at a position opposing the convey rollers 6*a* and 6*b*.

The tray support plate 9 is vertically movable along the lead cams 10*a* and 10*b* shown in FIG. 2 for at least the distance between an uppermost tray $7_1$ and the lowermost tray 7'.

The copy sheet 3 which is exhausted from the exhaust rollers of the main body 1 is fed into the feed-in guide 5 of the sorter 4. The leading edge of the copy sheet 3 is clamped between the convey rollers 6*a* and 6*b* after passing over a paper sensor 18. After the time required for the copy sheet 3 to reach the tray $7_2$ has passed, a bin motor 13 is energized. The rotational force of the bin motor 13 is transmitted to the lead cam 10*b* through a timing belt 22. The lead surfaces of the lead cams 10*a* and 10*b* partially comprise substantially horizontal surfaces. The rotational force of the bin motor 13 is also transmitted to gears 15*a* and 15*b*. A cam portion 25 has an eccentric shape for allowing a 1-revolution sensor 20 to detect one revolution of the lead cams 10*a* and 10*b*. The gears 15*a* and 15*b* and the cam portion 25 are formed integrally on the lead cam surfaces of the leads cams 10*a* and 10*b*. Sprockets 12*a* and 12*b* rotate in synchronism with the lead cams 10*a* and 10*b*. The lead cams 10*a* and 10*b* can rotate in the same direction and at the same period through a chain 11.

When the lead cam 10*b* rotates once upon being driven by the bin motor 13 through the chain 11, the 1-revolution sensor 20 detects the projecting portion of the cam portion 25. Then, the lead cam 10*b* stops rotating.

The arm members 19 are equidistantly and rotatably arranged on each side of the tray support plate 9. As has been described hereinabove, the distal end of each arm member 19 abuts against that end of the corresponding tray which is at the side of the copy sheet inlet port. The arm members 19 and the tray pivot support plate 8 support the tray group 7 such that the support plate 8 pivotally supports the opposite end (i.e., the one further from the inlet port) of each tray. The projections 14*a* and 14*b* mounted at the two ends of the tray support plate 9 are engageable with the lead surfaces of the lead cams 10*a* and 10*b*, respectively. When the lead cams 10*a* and 10*b* rotate clockwise once, the tray support plate 9 is moved upward by the lead distance of the lead cams 10*a* and 10*b*. The tray support plate 9 is stopped at the position determined by the substantially horizontal portions of the lead surfaces which were described above.

The bin moving operation of the sorter will now be described. When the bin motor 13 is rotated clockwise (lead cams rotate counterclockwise), the tray group 7 is moved to its lowermost (home) position. Then, a home position sensor 21 detects by means of the projection 14*a* caulked to the tray support plate 9 that the sheet inlet port of the lowermost tray $7_1$ has reached the position corresponding to the nips of the convey rollers 6*a* and 6*b*. The rotation of the bin motor 13 is then stopped by a controller (not shown) to be described later. The lower end of the tray support plate 9 is abutted against part of the bottom plate (not shown) of the sorter and is kept at this lowermost position. The copy sheet 3 is fed into the tray $7_1$. When the paper sensor 18 detects that the copy sheet 3 has been stored in the tray $7_1$ by means of the convey rollers 6*a* and 6*b* , the bin motor 13 is rotated counterclockwise (lead cams rotate clockwise) at a predetermined time after the detection of the trailing edge of the copy sheet 3. The lead cams then rotate clockwise once and position the tray support plate at the desired level by the substantially horizontal surfaces of the cam surfaces thereof. The rotation of the lead cams is then stopped.

The above-mentioned process is then repeated. The inlet port for receiving the copy sheet 3 is shifted a predetermined number of times at predetermined intervals. When the tray group 7 reaches its uppermost position (position B in FIG. 3), the projection 14*a* caulked to the tray support plate 9 is detected by an upper limit sensor 23. Then, the bin motor 13 is stopped by the controller (not shown). The bin operation is not subsequently performed even if more copy sheets 3 are received.

Springs 26*a* and 26*b* are wound around shafts 10*a*' and 10*b*', respectively, supporting the corresponding lead cams 10*a* and 10*b*. If, for any reason, the home position sensor 21 or the upper limit sensor 23 does not detect the projection 14*a* even after the tray group 7 has reached the lowermost position (home position) or the uppermost position, respectively, the bin motor 13 continues to rotate in the same direction. In this case, a force exceeding the allowable shearing force may act on the projections 14*a* and 14*b* of the tray support plate 9 which engage with the lead cams 10*a* and 10*b*. Even if this occurs, since the springs 26*a* and 26*b* described above are mounted on the shafts 10*a*' and 10*b*' supporting the lead cams 10*a* and 10*b* and are normally biased downward, the tray group 7 is kept at the home position and the projections 14*a* and 14*b* on the tray support plate 9 are moved upward or downward together with the lead cams 10*a* and 10*b* along the shafts 10*a*' and 10*b*' by means of the contraction/expansion of the springs 26*a* and 26*b*. Therefore, damage to the projections 14*a* and 14*b* is prevented.

Details of the function of the arm members will now be described. When the uppermost arm member 19 abuts against a cam portion 17*a* of a fixed cam plate 17 which is positioned and screwed to a sorter side plate 16, one end of the arm member 19 is pivoted downward about its fulcrum to move the projection 7*a* supported by the other end thereof upward along the elongated groove 9*a* of the tray support plate 9. Then, the uppermost tray $7_1$ is moved upward to open the sheet inlet port of the underlying tray $7_2$.

At this time, the tray $7_1$ is moved along the sheet convey direction. Since the tray $7_1$ is supported by the tray pivot support plate 8 to be movable along the sheet convey direction, the inclined angle of the tray $7_1$ is not changed and any positional change in the sheet convey direction is not caused. The specifications of the cam plate 17 and the arm members 19 are determined such that even if the tray is pivoted about a fulcrum 8*a*, the tray is positioned so that the distance between the end of the tray at the side of the sheet inlet port and the nips of the convey rollers 6*a* and 6*b* remains constant. Positioning of the arm members 19 at their normal positions where they do not urge the tray group upward is achieved by means of projections 27 positioned on and caulked to the tray support plate 9.

Figure 4:
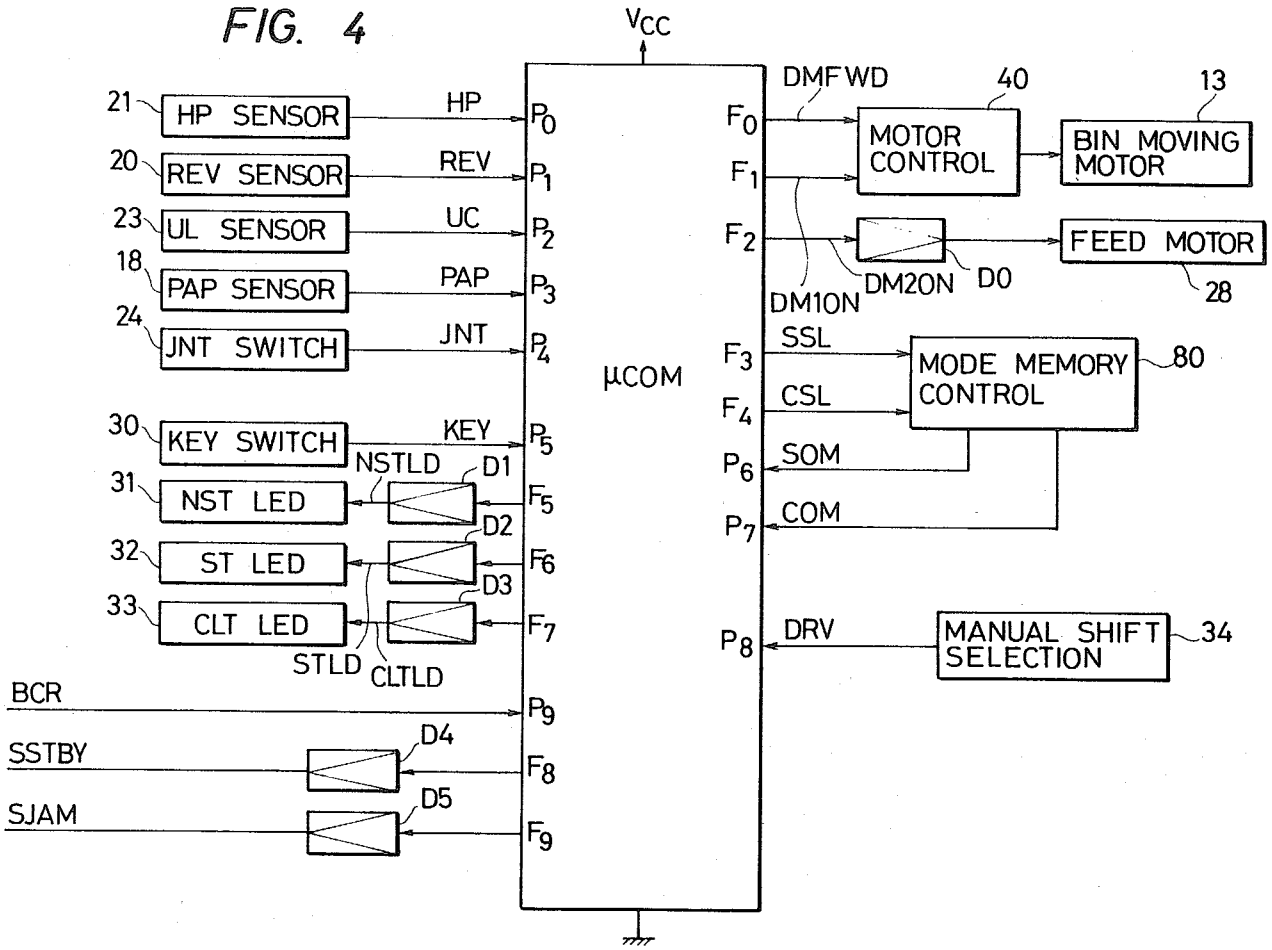
FIG. 4 is a block diagram showing a controller of the sorter.

FIG. 4 is a block diagram of the controller for performing the mode of operation described above. The controller mainly consists of a known one-chip microcomputer (to be referred to as a $\mu$ COM) having a ROM, a RAM and the like. The controller exchanges signals with the controller of the copying machine main body 1 so as to control the sorter 4.

Input ports P0 to P4 of the $\mu$ COM respectively receive signals from the home position sensor (to be referred to as an HP hereinafter) 21, the 1-revolution sensor (to be referred to as a REV hereinafter) 20, the upper limit sensor (to be referred to as a UL hereinafter) 23, the paper sensor (to be referred to as a PAP hereinafter) 18, and the joint switch (to be referred to as a JNT hereinafter) 24. An input port P5 of the $\mu$ COM receives a signal from the mode selection switch (to be referred to as a KEY hereinafter) 30. As will be described later, in order to display which one of the modes is selected, output ports F5 to F7 of the $\mu$ COM supply, through drivers D1 to D3, ON signals to the non sort LED (to be referred to as an NSTLD hereinafter) 31, the sort LED (to be referred to as an STLD hereinafter) 32, and the collate LED (to be referred to as a CLTLD hereinafter), respectively. Input ports P6 and P7 of the $\mu$ COM receive a sort mode memory output SOM and a collate mode memory output COM from a mode memory control 80 to be described later. Output port F3 or F4 of the $\mu$ COM produces a sort mode selection signal SSL or a collate mode selection signal CSL to the mode memory control 80 when the corresponding sort mode or collate mode is selected.

An input port P8 of the $\mu$ COM receives a manual selection signal (to be referred to as a DRV hereinafter) 34 from a switch formed on the same chip of the controller.

Output ports F0 and F1 supply a motor direction switch signal (to be referred to as a DMFWD) and a motor drive signal (to be referred to as a DM1ON) to a bin motor control 40 so as to drive the bin motor 13. The $\mu$ COM supplies, through a driver D0 from an output port F2, a motor drive signal (to be referred to as a DM2ON) so as to drive the sheet convey motor 28. An input port P9 receives a bin cam return signal BCR as an operation command signal from the copying machine main body 1. Output ports F8 and F9 produce a sorter standby signal SSTBY and a sorter jam signal SJAM through drivers D4 and D5, so as to signal the status of the sorter 4 to the copying machine main body 1, thereby achieving matching therebetween. Fetching of these input signals and ON/OFF of the loads are controlled in accordance with a program stored in the ROM of the μ COM.

Figure 5:
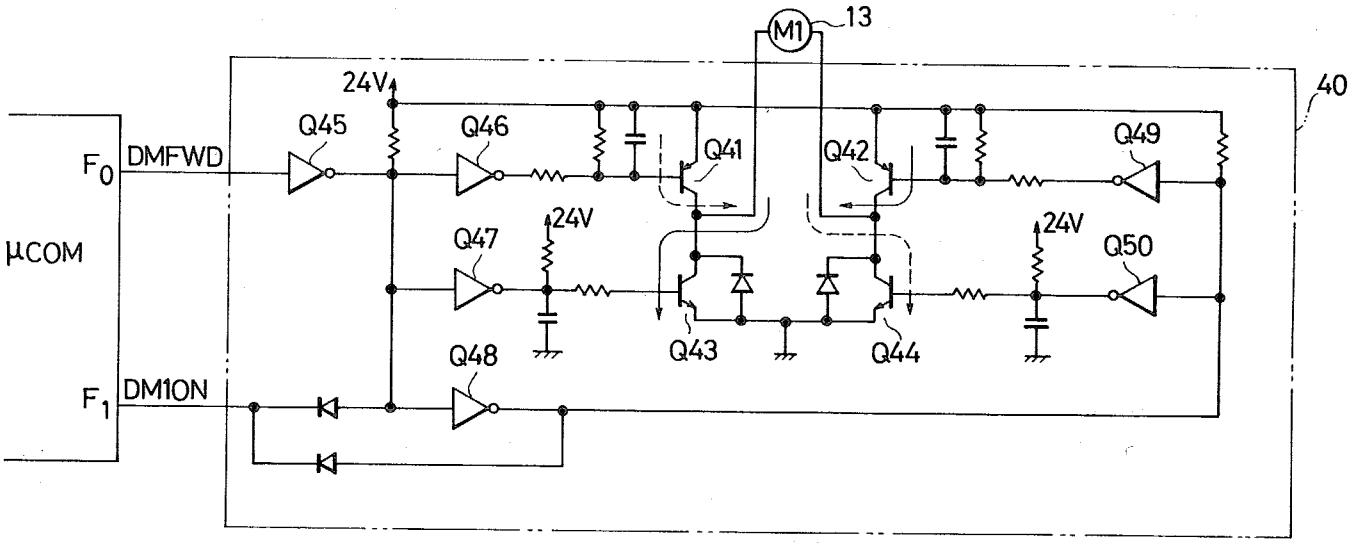
FIGS. 5 and 6 are circuit diagrams showing details of part of the controller shown in FIG. 4.

FIG. 5 is a circuit diagram showing details of the bin motor control which controls the bin motor 13. When the bin motor 13 is driven in the forward direction so as to shift the bins, the output port F0 produces the signal DMFWD ="H" and the output port F1 produces the signal DMlON ="H". When the signal DMFWD ="H", an output from an inverter Q45 is at "L" level and an output from an inverter Q46 is at "H" level. A transistor Q41 is turned off. Since an output from an inverter Q47 is at "H" level, a transistor Q43 is turned on. Since the signal DMlON is at "H" level, an output from an inverter Q48 is at "H" level and an output from an inverter Q49 is at "L" level. A transistor Q42 is turned on. Since an output from an inverter Q50 is at "L" level, a transistor Q44 is turned off. As a result, a current flows in the direction indicated by solid arrows, and the bin motor 13 is rotated in the forward direction.

When the bin motor 13 is to be driven in the reverse direction so as to return the tray group to the home position, the μ COM produces the signals DMFWD ="L" and DMlON ="H". Since the signal DMFWD is at "L" level, an output from the inverter Q45 is at "H" level and the output from the inverter Q46 is at "L" level. The transistor Q41 is turned on. Since the output from the inverter Q47 is at "L" level, the transistor Q43 is turned off. Since the signal DMlON ="H", an output from the inverter Q48 is at "L" level and an output from the inverter Q49 is at "H" level. The transistor Q42 is turned off. Since an output from an inverter Q50 is at "H" level, the transistor Q44 is turned on. Then, a current flows in the direction indicated by broken arrows and the motor 13 is rotated in the reverse direction. When the bin motor 13 is to be stopped next, the signal DMlON is set at "L" level independently of the level of the signal DMFWD. Then, an input to the inverter Q48 is at "L" level and an output from the inverter Q48 is at "L" level and an output from the inverter Q48 is at "L" level. Therefore, an output from the inverter Q46 is at "H" level, and the transistor Q41 is turned off. Since an output from the inverter Q47 is at "H" level, the transistor Q43 is turned on. Since an output from the inverter Q49 is at "H" level, the transistor Q42 is turned off. Since an output from the inverter Q50 is at "H" level, the transistor Q44 is turned on. Therefore, the two ends of the motor 13 are grounded, and the motor 13 is instantaneously stopped.

Figure 6:
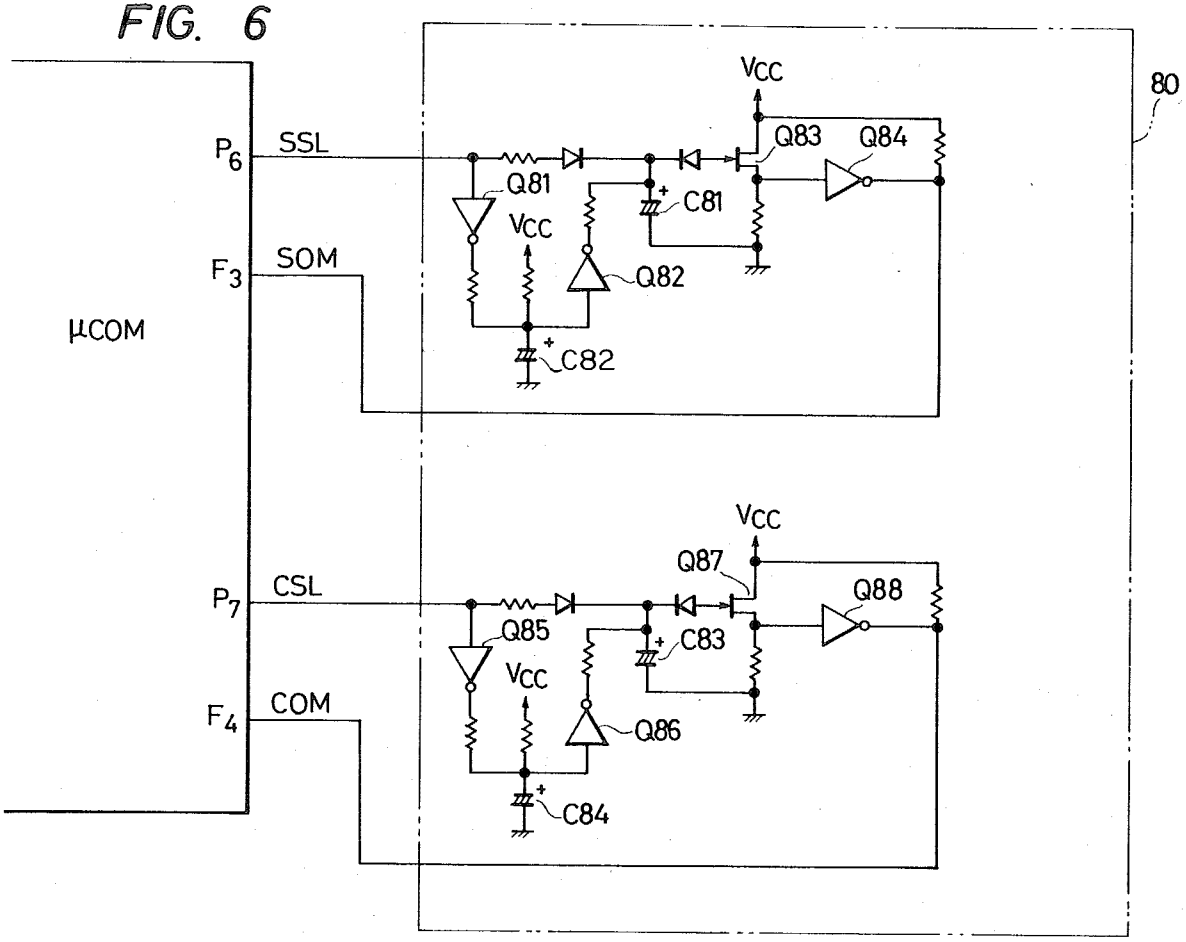

FIG. 6 is a circuit diagram of the mode memory control 80. Sorter power is supplied from the copying machine main body. Even if the sorter power is turned off such as in the case of removal of a jammed sheet, the mode immediately before power off is retained. When the sort mode is selected, the signal SSL ="H" is produced from the output port P6 in accordance with the control program to be described later of the μ COM. Then, a capacitor C81 starts to be charged to turn on an FET Q83. An output from an inverter Q84 is at "L" level, the signal SOM is set at "L" level, so that the input port F3 receives a signal of "L" level. The program of the μ COM discriminates the "L" level of the signal SOM as an indication of the sort mode selection. The capacity of the capacitor C81 is set to be large enough so that even if the sorter power is cut off in this case, the discharge time of the capacitor C81 becomes about 10 to 20 minutes. Then, when power of the sorter 4 is resumed, an inverter Q82 is kept off for a time period (e.g., 100 ms) corresponding to a time constant which is determined by the capacitance of a capacitor C82 and a resistor connected in series therewith and to the power source. For this reason, even if the signal SSL ="L" is produced during this time period (100 ms from the timing of power ON), the charge on the capacitor Q81 is not discharged, and both the FET Q83 and the inverter Q84 are ON. In this state, the μ COM discriminates that SOM ="L" and produces the signal SSL="H" so as to perform the sort mode operation without any problem. Likewise, when the collate mode is selected, the signal CSL is at "H" level, and so the signal COM="L" is supplied to the μ COM. However, if the OFF period of the sorter power source is longer than the time constant described above, both signals COM and SOM are at "H" level upon power resumption. Then, the non sort mode is selected.

FIGS. 7 to 15 show a flow chart of the program according to the embodiment of the present invention.

Figure 7:
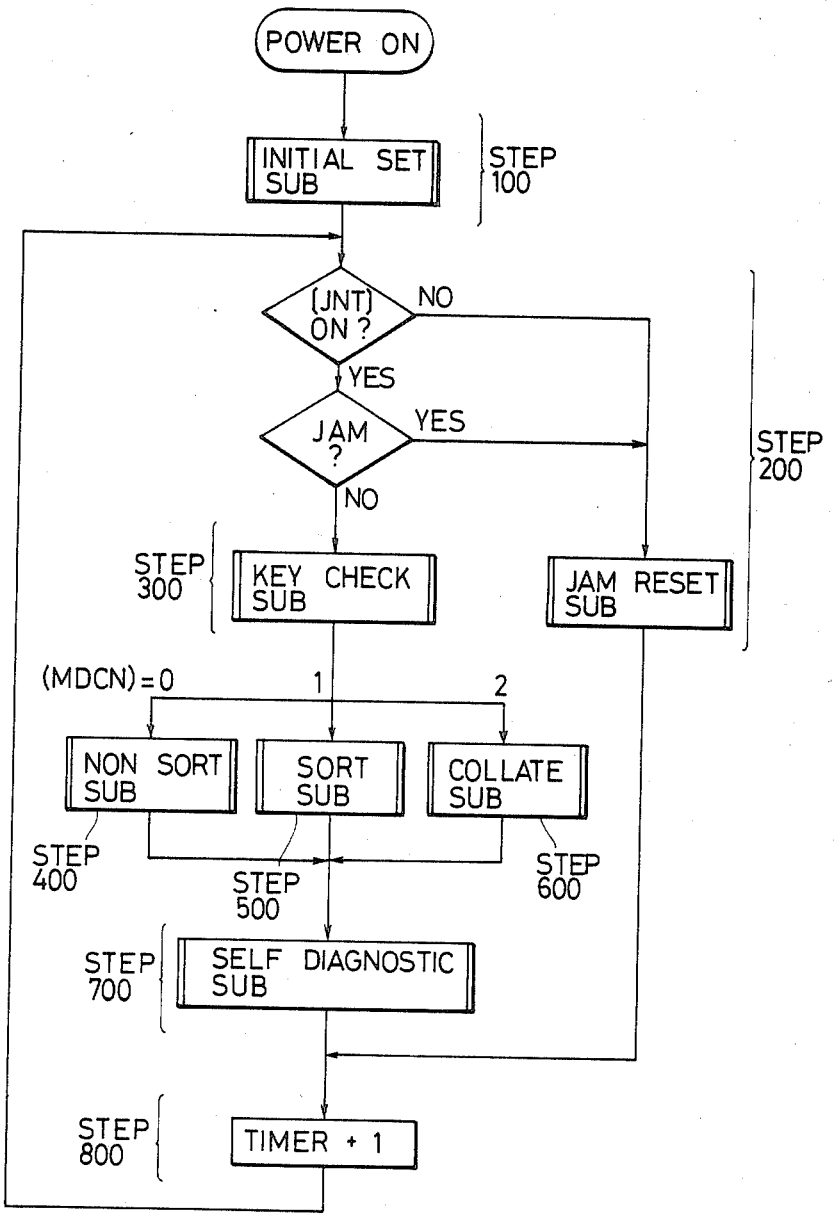
FIG. 7 is a flow chart showing the overall control sequence of the sorter.

FIG. 7 shows a schematic flow chart showing the main routine. After power is turned on, the initial set subroutine for initialization of the copying machine is performed in step 100. After step 100 is executed, the flow advances to step 200. Step 200 and thereafter forms a closed loop as the main loop. Step 200 is a subroutine for discriminating the status of the copying machine. The signal from the JNT is constantly monitored during operation of the sorter. If the signal from the JNT is not detected, the μ COM determines that the normal initialization has not been performed and a JAM RESET subroutine for warning is executed.

On the other hand, if the signal from the JNT is detected, it is then checked if jamming has occurred in the copying machine. If it is determined that jamming has occurred, the JAM RESET subroutine described above is performed.

If it is determined that the copying machine is in the normal state, the flow advances to step 300. Step 300 is a KEY CHECK subroutine for checking if the sorter mode selection has been made by the operator through the KEY (mode selection switch 30). After step 300 is executed, the flow goes to steps 400, 500 and 600 for executing the operation in the mode selected in step 300.

In this case, in accordance with the selected mode and the contents of a mode counter MDCN set in a predetermined area of the μ COM, the non sort subroutine (step 400), the sort subroutine (step 500) or the collate subroutine (step 600) is executed.

When the copying machine is set in the standby mode during the execution of one of the subroutines described above, the flow returns to the main routine and step S700 is executed next. In step 700, the self diagnostic subroutine for diagnosing various sensors for detecting the bin positions is executed.

In step 800, a timer to be described later is incremented by one and the flow returns to the main routine. When another subroutine is to be performed after return to the main routine, the second subroutine is executed from the state immediately before the first subroutine started.

The individual subroutines will now be described in detail.

Figure 8:
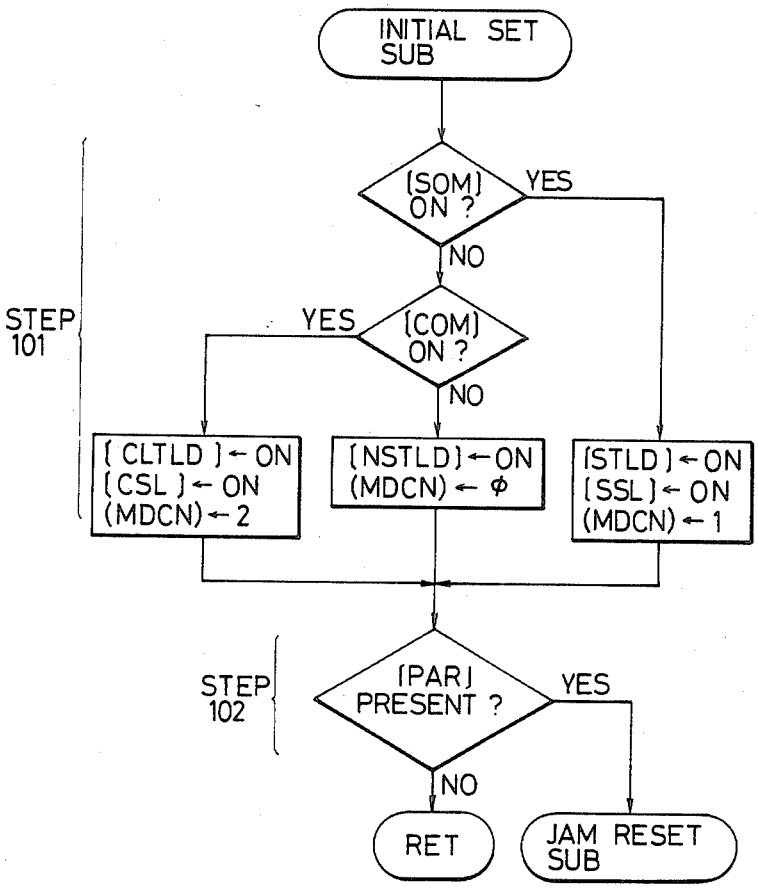
FIGS. 8 to 15, 15A and 15B are flow charts showing details of the subroutines of the flow shown in FIG. 7.

FIG. 8 shows the INITIAL SET subroutine after the power is turned on.

Referring to FIG. 8, in step 101, it is checked if signals SOM and COM are received from the mode memory control.

If the signal SOM is detected, it is determined that the sort mode is selected. Then, the STLD is turned on to indicate selection of the sort mode to the operator. Number "1" is set in the mode setting counter MDCN (to be described later) set in a predetermined area of the RAM of the $\mu$ COM, and the signal SSL is enabled.

Similarly, if the signal COM is detected, it is determined that the collate mode is selected. Then, the CLTLD is turned on, number 2 is set in the mode counter MDCN, and the signal CSL is enabled.

If neither of the signals SOM and COM are detected, it is determined that the non sort mode is selected. Then, the NSTLD is turned on, and number 0 is set in the counter MDCN Due to this step 101, the mode before the power OFF can be restored after power resumption.

In step 102, it is checked if any copy sheet is detected by the PAP. In order to prevent operation of the sorter with a copy sheet jammed in the sorter after power ON and to signal to the operator occurrence of jamming, the flow advances to the JAM RESET subroutine if paper jamming is detected.

However, if no jammed paper sheet is detected, the flow returns to the main routine.

Figure 9:
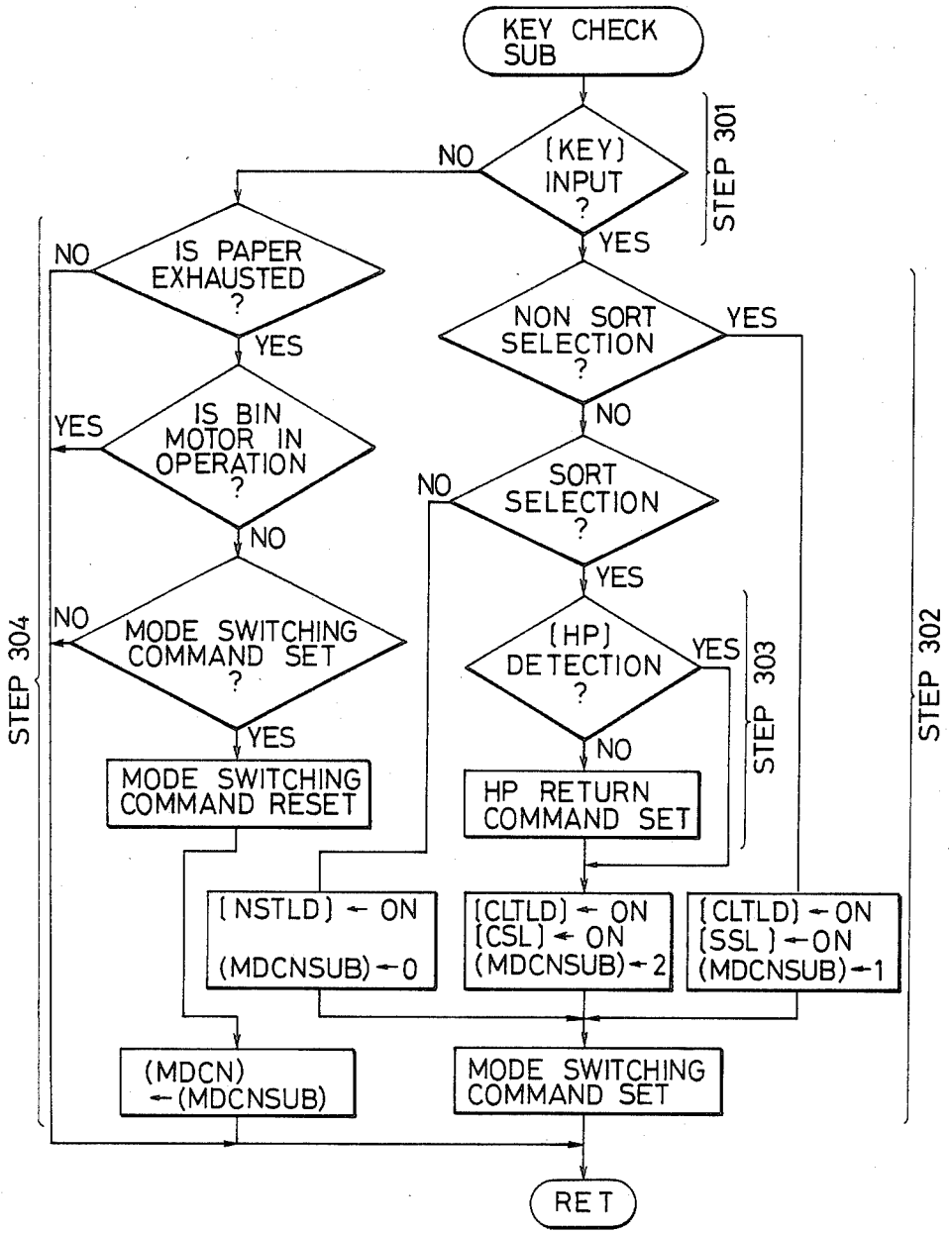

FIG. 9 shows a KEY CHECK subroutine. In this subroutine, switching operation upon selection of the mode by the operator through the KEY is executed.

In step 301, it is discriminated if the input of the signal from the KEY is present. If YES in step 301, the flow goes to step 302. If NO in step 301, the flow goes to step 304.

Step 302 is a step for switching the mode. Every time the KEY is operated, the mode display circulates in the order of non sort, sort, collate and non sort modes. If the non sort mode is selected, that is, if the KEY is operated while the NSTLD is ON, the display is changed to turn on the STLD. The signal SSL is produced, and the sort mode is selected.

When the mode is switched by operation of the KEY, the count of the mode counter MDCN for designating the routine to be executed is not changed immediately. Instead, number 1 (predetermined number) is set in a buffer counter MDCNSUB for the counter MDCN, and a mode switching command indicating that a mode selection has been made is set.

Thus, when the operator switches the mode by operating the KEY, the display is switched in accordance with the selected mode. However, the mode operation is not immediately changed.

Step 304 is a step for executing the mode switching operation when the operator turns off the KEY. Step 304 is executed when the sorter completely discharges the copy sheet into the bin and the bin motor 13 is stopped. When the mode switching command is set, the command is reset. The content of the buffer counter MDCNSUB is transferred to the counter MDCN. The routine for executing the selected mode is selected, and the flow returns to the main routine.

When the collate mode is selected, an HP return command is set so as to return the bin to the home position HP in step 303.

Since this step 303 is executed, when the operator selects the collate mode, the sorter is started only after the bins are returned to the home position.

Figure 10:
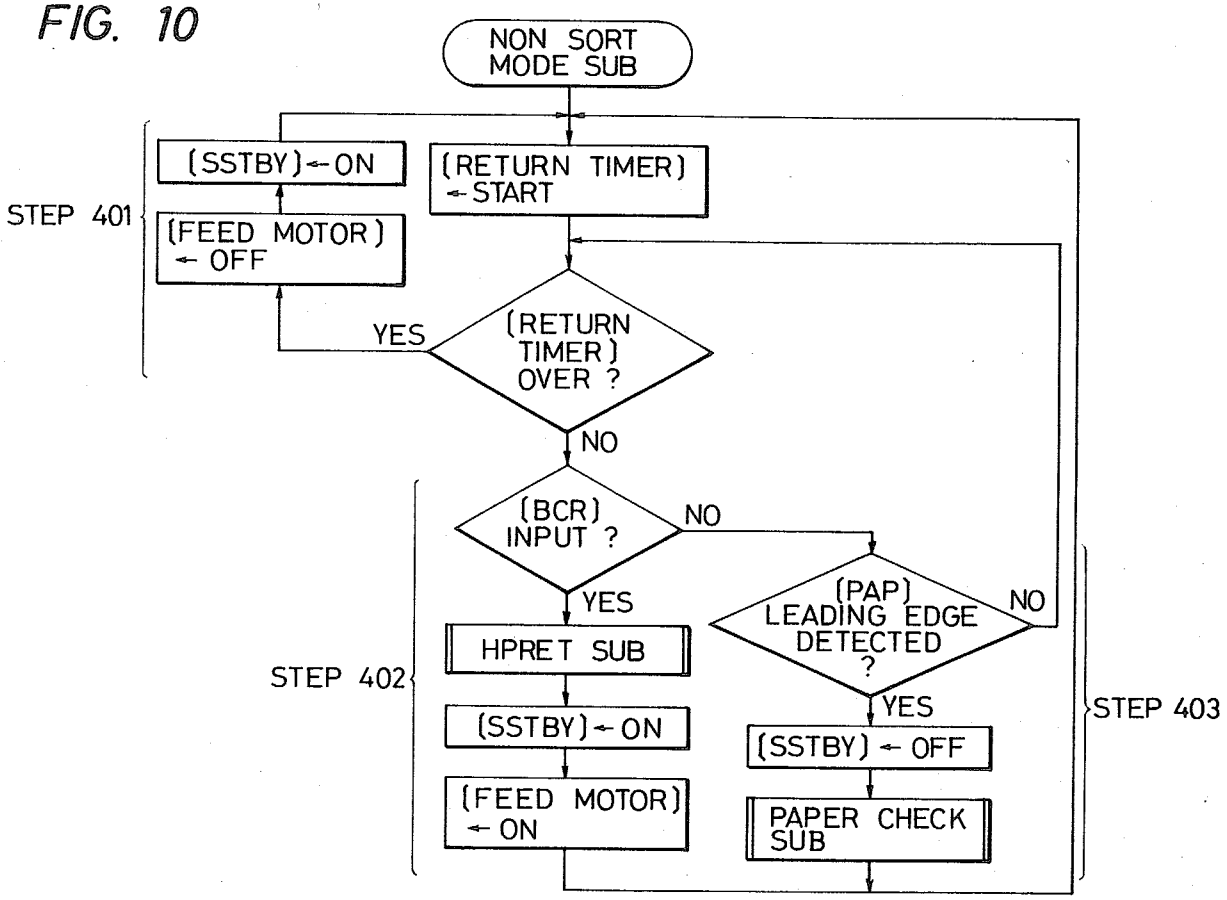
Figure 11:
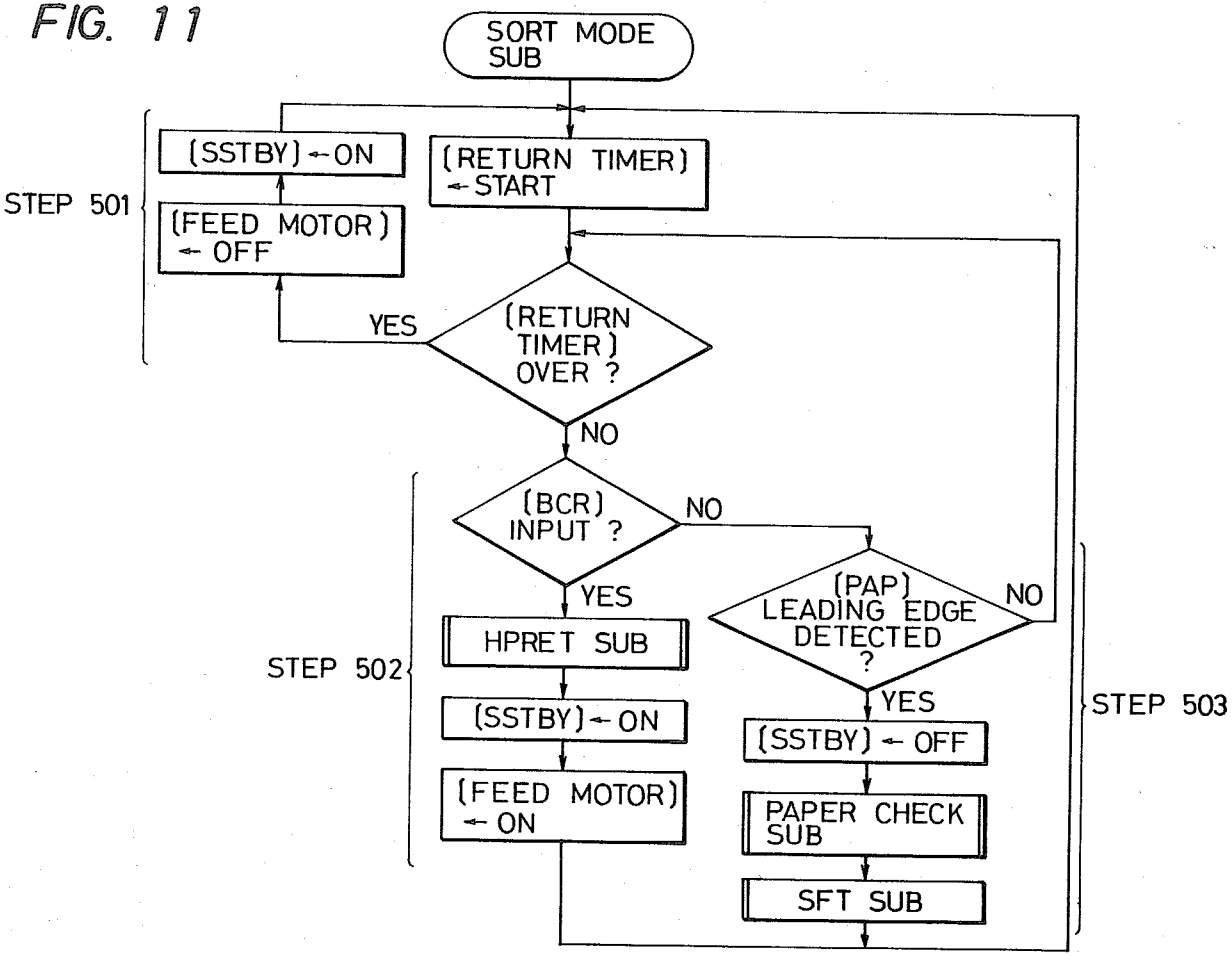
Figure 12:
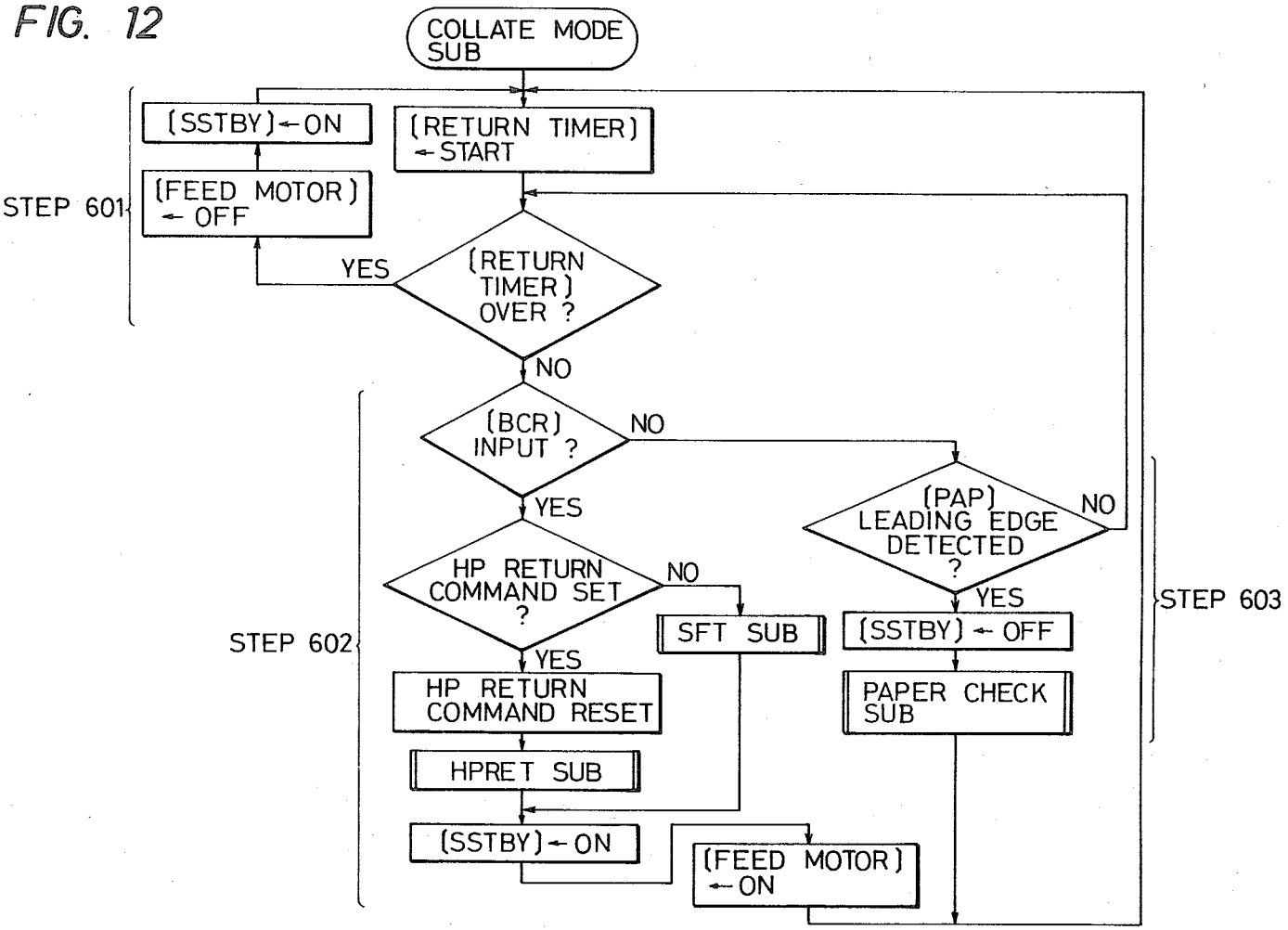

FIGS. 10 to 12 are flow charts showing details of the subroutines for performing the three different modes.

Figure 14:
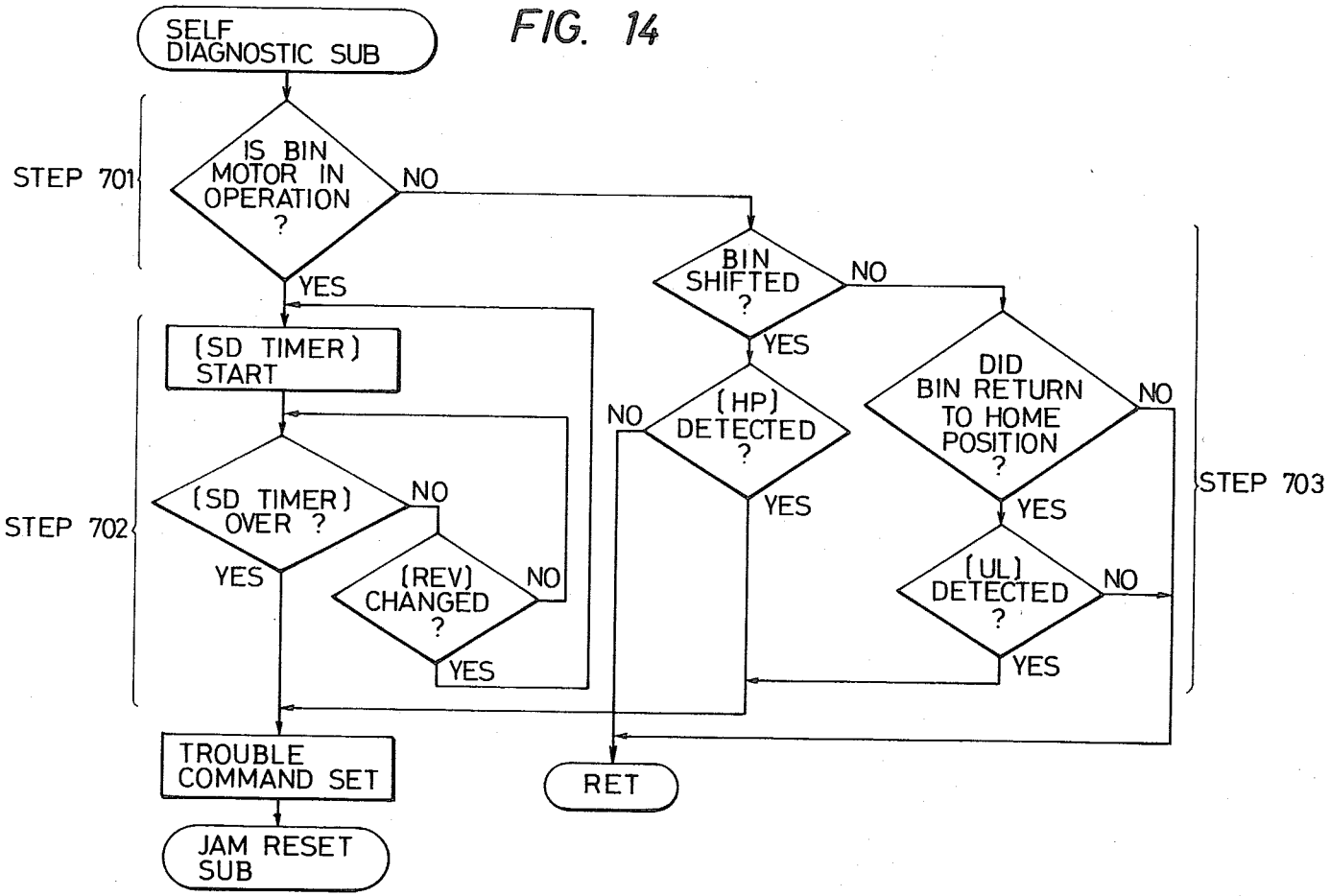

FIG. 14 is a flow chart showing a CALL subroutine which may be executed in these flow charts.

FIG. 10 shows the flow chart of the non sort mode subroutine for performing the non sort mode.

In the non sort mode, in response to the signal BCR generated when the copy start key of the copying machine is operated, the bin group is returned to the home position. The copy sheets to be discharged from the copying machine in this mode are all stored in the first bin.

To describe in more detail, in step 401, the return timer is started to count a predetermined time period. Steps 402 and 403 are performed while the timer counts. This return timer is incorporated so as to stop the sorter when the signal BCR is not received within the predetermined time period.

Figure 13:
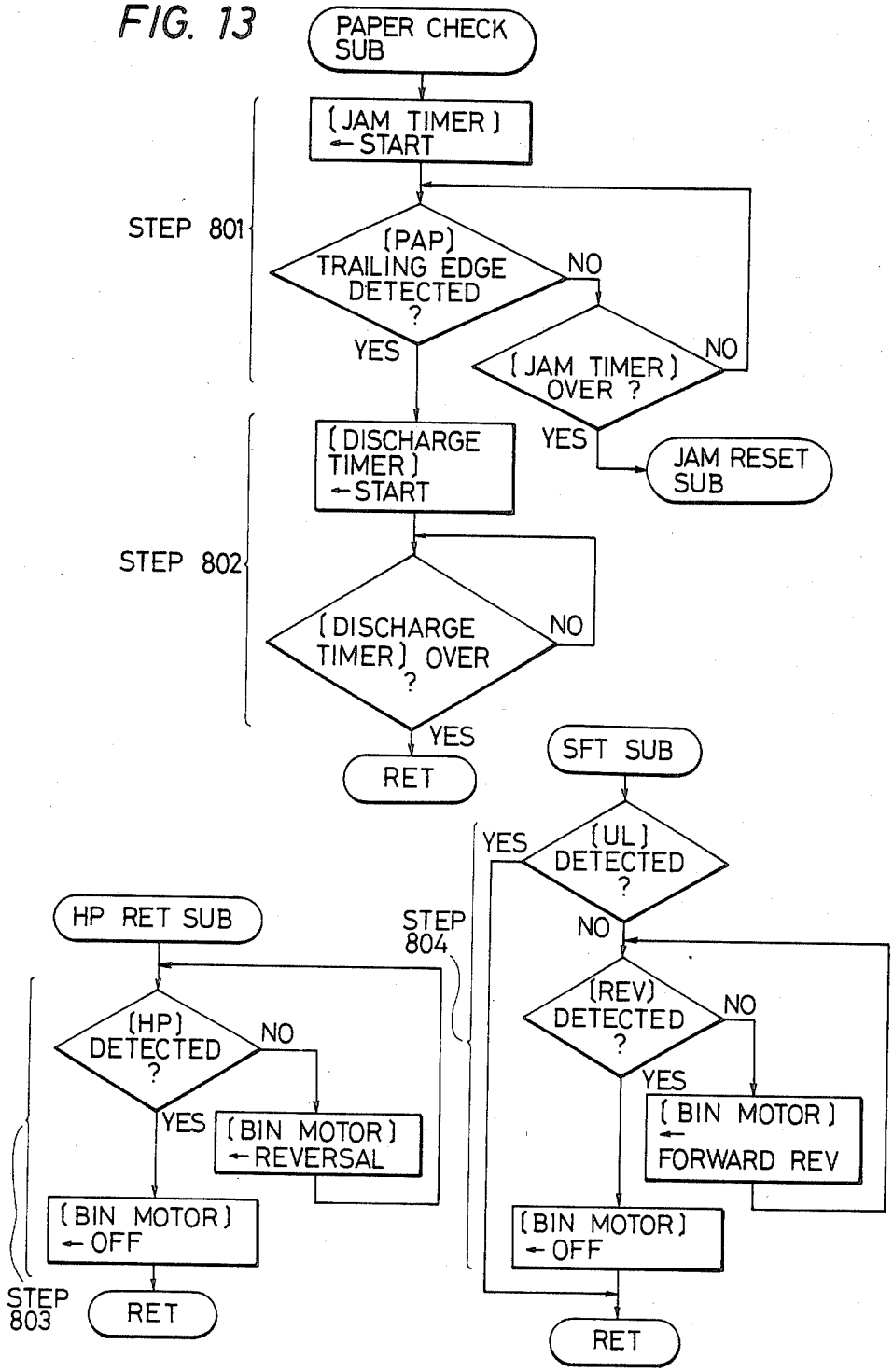

In step 402, input of the signal BCR as a start signal of the sorter from the copying machine is monitored. The HPRET subroutine shown in step 803 in FIG. 13 is executed so as to return the bin group to the home position. Until the signal HP is received, the bin motor 13 is rotated in the reverse direction so as to return the bin group to the home position. When the signal HP is detected, the motor 13 is stopped. A signal SSTBY which indicates that the sorter can receive a copy sheet from the copying machine is produced. The paper convey motor for conveying the received copy sheet is driven, and the sorter is set in the mode for waiting the return timer to end.

In step 403, the signal from the PAP is monitored to determine if the leading edge of the copy sheet has been detected by the PAP. Upon detection of the leading edge of the copy sheet, the signal SSTBY is disabled. In order to monitor the sorter until the copy sheet is safely received in the corresponding bin, the PAPER CHECK subroutine in steps 801 and 802 shown in FIG. 13 is executed.

Referring to FIG. 13, in step 801, in order to monitor if the copy sheet has passed by the PAP, the jam timer is started. The detection of the trailing edge of the copy sheet by the PAP is monitored until the jam timer ends. If the timer ends before the trailing edge of the copy sheet is described by the PAP, the JAM RESET subroutine to be described later is executed in order to display occurrence of jamming.

If no such abnormality has occurred, the flow goes to step 802. In step 802, the discharge timer is started as an interval timer for counting an interval from the passage of the trailing edge of the copy sheet by the PAP to the storage of the copy sheet in the corresponding bin. After the timer ends, the paper sheet is regarded to have been discharged, and the sorter is set in the above-mentioned mode for awaiting the end of the return timer (step 401 in FIG. 10).

Referring back to FIG. 10, when it is determined in step 401 that the return timer has ended, the paper convey motor which is now being driven is turned off. In step 403, the signal SSTBY which is now disabled is enabled to restore the initial state.

When the copying machine produces a signal BCR upon depression of the copy start key by the operator and the sorter returns the bin to a predetermined position, the copy operation is inhibited until the sorter returns a signal SSTBY to the copying machine. If the time period from the copy operation start to the discharge of the copy sheet changes depending upon the timing of depression of the copy start key, for example, if the copy start key is turned on immediately after the previous copying operation is completed, the time period up to the discharge of the copy sheet is short. On the other hand, if the copy start key is turned on at a predetermined time for post-rotation of the drum from the end of the previous copying operation, the discharge of the copy sheet is delayed.

In such a case, the time to be set in the return timer can be set to be equal or shorter than the abovementioned predetermined time. Then, when the copy start key is on, the signal SSTBY is already enabled. Therefore, the copying machine can immediately start the copying operation. Meanwhile, in response to the signal BCR, the sorter starts returning the bin group to the home position. In this case, the copy sheet is discharged at a timing after the first bin reaches the predetermined position, and the copy sheet is stored in the corresponding bin. This means that the copy speed is faster than the normal case by the time period corresponding to the time required for the bin to return to the home position. However, if the discharge of the copy sheet is completed faster than the return movement of the bin, the return timer has not ended and the signal SSTBY is disabled when the copy sheet is discharged. Thus, when the signal SSTBY is enabled when the bin group has returned to the home position in response to the signal BCR, the copy operation is inhibited until the signal SSTBY is enabled and therefore the copy sheet can be stored in the corresponding bin.

If the copy sheet cannot be discharged due to jamming, the stop key ON or the like, the initial state may be restored when the return timer ends.

FIG. 11 shows the flow of the sort mode subroutine for performing the sort mode.

In the sort mode, in response to the signal BCR generated upon depression of the copy start key of the copying machine, the bin group is returned to the home position. The discharged copy sheets are sequentially stored in the bins. If copy sheets numbering more than that the bins are discharged, the remaining copy sheets are stored in the lowermost bin.

Steps 501 and 502 of this subroutine are equivalent to steps 401 and 402 shown in FIG. 10 and a description thereof is omitted. However, in step 503 shown in FIG. 11, the leading edge of the copy sheet discharged from the copying machine is detected by the PAP, and the signal SSTBY is disabled. Then, the PAPER CHECK subroutine shown in FIG. 13 is executed. In the PAPER CHECK subroutine, discharge of the copy sheet is monitored. When the copy sheet is normally discharged, the SFT subroutine in step 804 shown in FIG. 13 is executed.

In step 804, a signal UL for checking to determine if the bin is at its uppermost position is monitored. If the signal UL is detected, further bin shift is inhibited.

If the signal UL is not detected, the bin motor 13 is rotated in the forward direction. After a signal REV indicating one revolution of the cams is detected, it is determined that one bin shift is completed. Then, the bin motor is stopped, and the flow returns to step 503 and thence to step 501.

The signals BCR and SSTBY for achieving synchronization between the copying machine and the sorter are controlled in a similar manner.

FIG. 12 shows the flow of the collate mode subroutine for performing collate mode.

In the collate mode, the bins are one-bin shifted in response to the signal BCR produced when the copy start key of the copying machine is depressed. The copy sheets discharged by this copying operation are all stored in a predetermined bin. Thus, every time the copy start key is depressed, the bins are shifted.

To describe this subroutine in more detail, in steps 601 and 602, the signal BCR as a start signal of the sorter from the copying machine is monitored. When the signal BCR is received, the following two operations are performed.

When the mode is changed to the collate mode from the sort mode by means of the KEY in step 303 in FIG. 9, it is first checked if the bin group is at the home position. If the bin group is not at the home position, it is checked in step 602 if the HP return command is set. If the HP return command is set, the HPRET subroutine is executed so as to return the bin group to the home position. However, if the HP return command is not set, the SFT subroutine is executed so as to perform one-bit shift.

FIG. 14 shows the flow of the SELF DIAGNOSTIC subroutine. In this subroutine, the sensor which is turned on or off upon shifting movement of the bins is monitored. If there is any abnormality, the JAM RESET subroutine is executed wherein the trouble command is set to signal the abnormality to the operator.

Referring to FIG. 14, in step 701, it is checked to determine if the bin motor is in operation. If YES in step 701, the flow advances to step 702. However, if NO in step 701, the flow advances to step 703.

In step 702, it is checked to determined if the signal REV changes before the self diagnosis timer ends in order to monitor the signal from the REV during movement of the bins, that is, to monitor if the bins move normally. Thus, abnormality of the bin motor and of the signal from the REV is checked.

If it is determined in step 703 that the HP has produced a signal when the bins are shifted, the abnormality of the HP is detected. If the UL produces a signal while the bin group is at the home position, the abnormality of the UL is detected.

Figure 15:
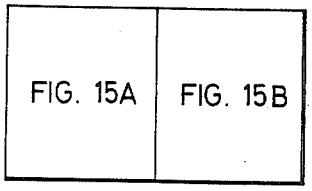
Figure 15A:
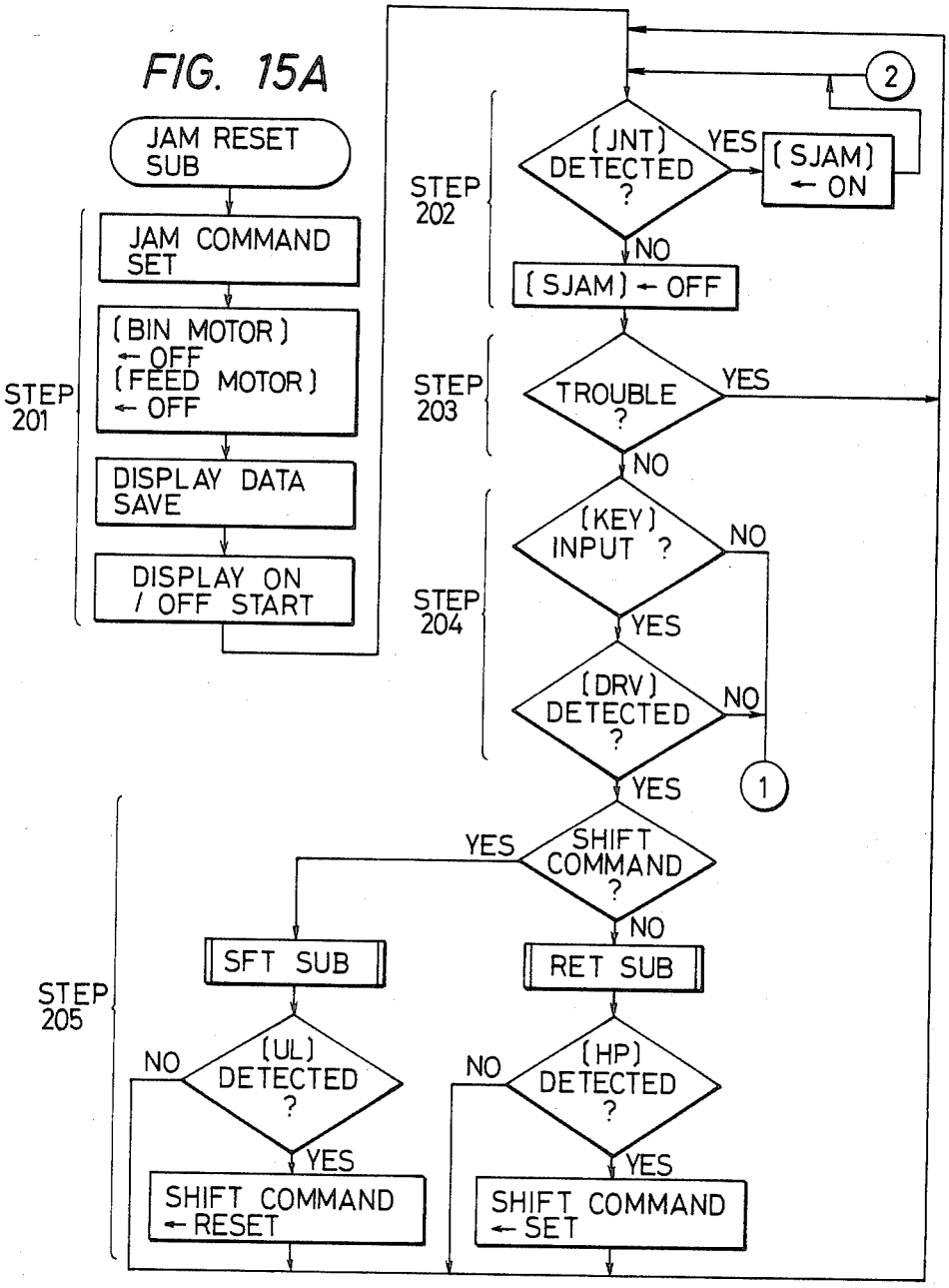
Figure 15B:
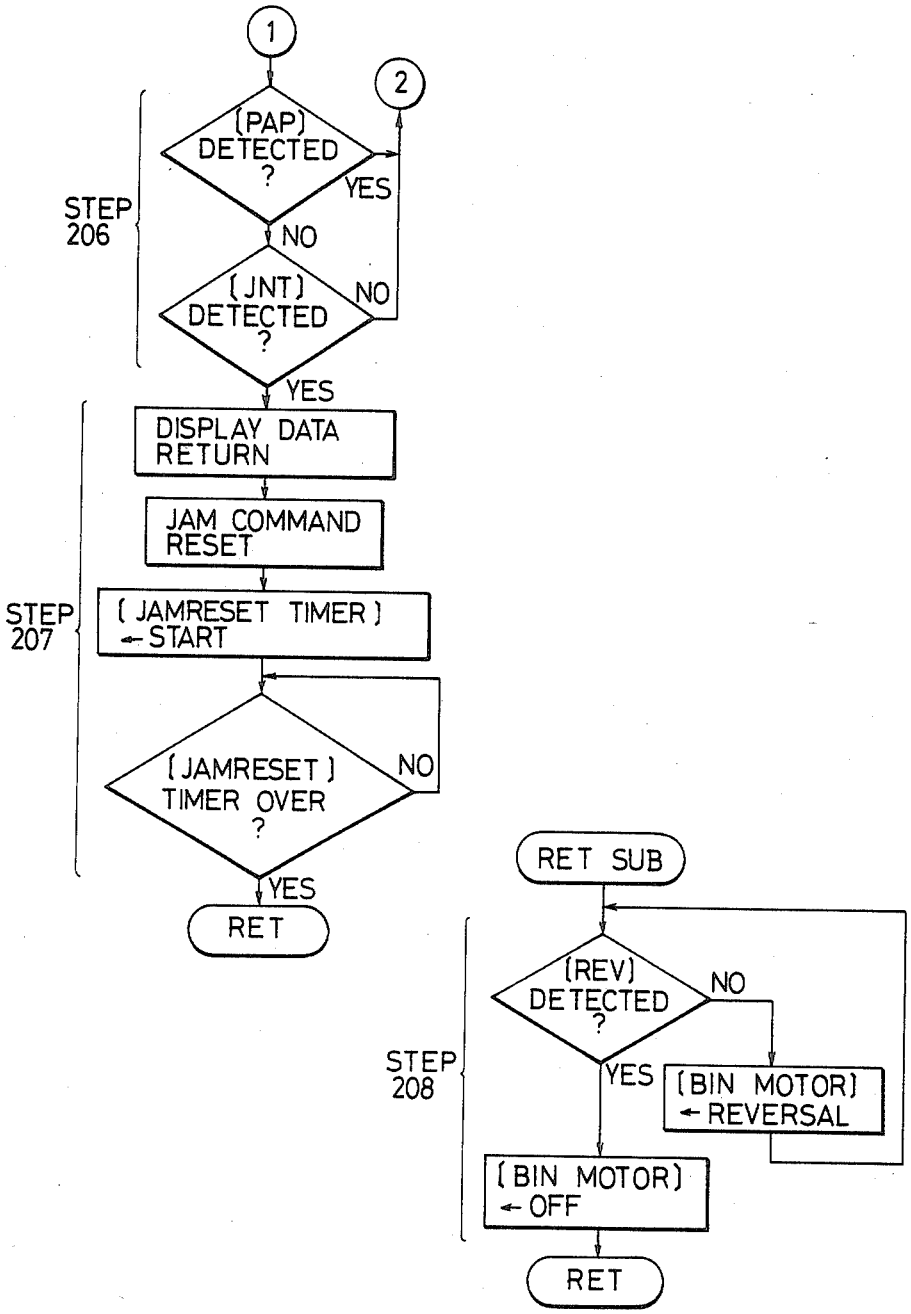

FIG. 15 shows the flow of the JAM RESET subroutine. In this subroutine, the abnormality is signalled to the operator, the loads are stopped, and release of the abnormality is monitored.

Referring to FIG. 15, in step 201, a JAM command indicating the occurrence of jamming is set. The bin motor and the paper convey motor are stopped. Display data corresponding to the currently selected mode is saved. At the same time, the NSTLD, STLD and CLTLD are simultaneously flashed to signal to the operator the occurrence of the abnormality.

In step 202, the detection result of the JNT is checked. If it is determined that there is an abnormality, the sorter produces a signal SJAM indicating the abnormality of the sorter to the copying machine. Then, the copying machine inhibits the copying operation or the like. When the operator turns off the JNT so as to release the abnormality, the signal SJAM is turned off. Thus, even if the sorter has the abnormality, the sorter can be disconnected from the copying machine to release the copying operation inhibition.

In the SELF DIAGNOSTIC subroutine, it is checked in step 203 to determine if there is any trouble which corresponds to an abnormality in the sensors for controlling the operation of the sorter. The release of the abnormality is inhibited.

When the bins are shifted with the copy sheet clamped between the convey rollers and the bin for some reason, it may be difficult for the operator to remove the jammed copy sheet. As a measure against this, in steps 204 and 205, when the sorter is disconnected from the copying machine, every time the input from the KEY is turned on, the mode switching is not performed but the bins are one-bin shifted. Then, the operator can easily remove the jammed sheet.

In step 204, whether this operation is to be performed or not is determined in accordance with the presence or absence of the input DRV.

In step 205, in order to shift the bins every time an input is received from the KEY, the RET subroutine to be described later and the SFT subroutine described above are executed. If it is determined in step 205 that there is no shift command, the bins are returned to the home position. If it is determined bin step 205 that there is a shift command, the bins are shifted. In the RET subroutine, in step 208, the bin motor is rotated in the reverse direction. After the REV produces an output, that is, when the one-bin shift is completed, the motor is turned off. After the bins are one-bin shifted upon reception of each input from the KEY in step 205 and the bins reach the home position, the bins are further one-bin shifted in the opposite direction. When the bins finally reach the uppermost position, the bins are one-bin shifted again toward the home position.

In step 206, the output from the PAP is monitored so a to determine if the jammed sheet has been removed for release of the abnormality. After it is determined that the PAP output is off, the output from the JNT is monitored to determine the sorter is to be set on the copying machine. If YES in step 206, the release of the abnormality is executed.

Step 207 is performed so as to release the abnormality. The display data saved in step 201 is returned. The mode is returned to one which was selected before the abnormality occurred. The JAM command is reset, and the end of the jam reset timer is awaited for a predetermined interval after the release of the abnormality. Then, the flow returns to the main routine. A time period equal to or longer than the time for allowing no erroneous detection due to vibration of the PAP upon setting of the sorter on the copying machine is set in the jam reset timer so that bin shifting is prevented in the sort mode.

As an example of a timing for mode switching described above, when a switch is made to the collate mode during the copy sheet convey operation in the sort mode, the copy sheet is conveyed first and then the collate mode is set. The remaining copy sheets are stored in the bins at the current positions. However, when the same mode switching is made during the shift ing operation of the bins, the remaining copy sheets are stored in the bins after the bins are shifted. When the copy start key is depressed in the collate mode, the bins are turned to the home position first and the collate mode operation is started.

When a switch is made to the sort mode during operation in the non sort mode, the bins are shifted after the copy sheet is completely conveyed, and the operation is continued in the sort mode.

When a switch is made to the non sort mode during operation in the collate mode, the sheet is conveyed completely first and then the sheet is stored in the bin at this position.

When the mode selection is made during convey operation of the copy sheet and the copy sheet is jammed, the mode after release of the jammed state is the switched new mode. This also applies to the case of power resumption when power is turned off after jamming is detected.

In the embodiment described above, the bins are shifted. However, the bins can be held stationary, and a deflecting means for deflecting copy sheets can be used. Furthermore, in the embodiment described above, the bins are shifted by operation of the mode selection key. However, a special key may be incorporated for this purpose.

We claim:

1. A sheet handling apparatus, usable with an disconnectable from a image forming apparatus, comprising:

storage means having a plurality of storage sections for storing sheets which are transferred from the image forming apparatus;

feeding means for feeding the sheets to said storage means;

moving means for moving said storage means and said feeding means relative to each other;

sensing means for sensing that said sheet handling apparatus is disconnected from said image forming means;

manual input means for inputting a signal to cause relative movement between said storage means and said feeding means; and control means for controlling said moving means to provide the relative movement between said storage means and said feeding means in response to the signal from said manual input means when it is detected by said sensing means that said sheet handling apparatus is disconnected from said image forming apparatus.

2. An apparatus according to claim 1, wherein said sheet handling apparatus can store the sheets in a plurality of sheet handling modes, and has selecting means for selecting a particular sheet handling mode from the plurality of sheets handling modes.

3. An apparatus according to claim 2, wherein said manual input means also serves as said selecting means.

4. An apparatus according to claim 1, wherein said moving means moves said storage means and said feeding means in a direction opposite to that for storing the sheets in said storing means, in response to a signal from said input means.

5. A sheet handling apparatus comprising:

storage means having a plurality of storage sections for storing sheets;

processing means for storing the sheets in said plurality of storage sections in a plurality of sheet handling modes;

selecting means for selecting a desired sheet handling mode from the plurality of sheet handling modes; and control means for controlling said processing means in such a manner than during an operation in one sheet handling mode, if another mode is selected by operation of said selecting means, a switch from said one sheet handling mode to said another is carried out in a timing corresponding to a time point when processing of a sheet which is in course of processing by said processing means in said one sheet handling mode is completed.

6. An apparatus according to claim 5, wherein the plurality of modes includes a first mode for individually storing a series of sheets in mutually different storage sections among said plurality of storage sections.

7. An apparatus according to claim 6, wherein the plurality of modes includes a second mode for storing the series of sheets in a certain single storage section among said plurality of storage sections.

8. An apparatus according to claim 7, wherein the plurality of modes includes a third mode wherein all sheets are stored in any one of said plurality of storage sections.

9. An apparatus according to claim 8, wherein in the event that during operation in the second mode, the third mode is selected by said selecting means, mode switching is accomplished when the sheet transfer is completed, and the sheets are stored in the storage section used in the second mode.

10. An apparatus according to claim 7, wherein when a switch is made to the second mode during operation in the first mode and before completion of sheet storage, the sheet is completely stored first and then the mode is changed from the first mode to the second mode, and the sheet is stored in a storage section among said plurality of storage sections which stored the last sheet in the first mode.

11. An apparatus according to claim 7, wherein when a switch is made to the second mode during operation in the first mode and before a switch is made to the next storage section among said plurality of storage sections, the switch to the next storage section is made first and then the sheet is stored in the next storage section in the second mode.

12. An apparatus according to claim 8, wherein when a switch is made to the first mode during operation in the third mode, storage of the sheets in the third mode is completed first and the sheets are stored in the first mode.

13. A sheet handling apparatus comprising:

storage means having a plurality of storage sections for storing sheets;

processing means for storing the sheets in the plurality of storage sections in a plurality of sheet handling modes; and selecting means for selecting a sheet handling mode, which is the same as had been selected immediately before power was turned off, from among the plurality of sheet handling modes, when the power is re-turned on within a predetermined time period from the time when the power is turned off, and for selecting a predetermined sheet handling mode, when the power is re-turned on after said predetermined time period has elapsed.

14. A sheet handling apparatus, usable with and disconnected from an image forming apparatus, comprising:

storage means for storing sheets conveyed from the image forming apparatus;

sheet detecting means for detecting the sheets conveyed from the image forming apparatus toward said storate means for the purpose of sheet storage control of said storage means;

state detecting means for detecting a disconnected state between said sheet handling apparatus and the image forming apparatus; and control means for invalidating a sheet-presence signal outputted from said sheet detecting means in the event that the disconnected state is detected by said state detecting means.

15. An apparatus according to claim 14, wherein said control means is operable to invalidate the sheet-presence signal from said sheet detecting means within a predetermined time period from detection of a connected state between said sheet handling apparatus and the image forming apparatus.

16. An apparatus according to claim 14 or 15, wherein said sheet detecting means comprises an actuator and a reed switch.

17. A sheet handling apparatus comprising:

storage means having a plurality of storage sections for storing sheets transferred from an image forming apparatus;

feeding means for feeding the sheets to said storage means;

moving means for moving said storage means and said feeding means relative to each other;

detecting means for detecting the sheet conveyed from the image forming apparatus; and control means responsive to a predetermined input signal from the image forming apparatus, for causing said moving means to effect a relative movement of said storage means and said feeding means, for causing said feeding means to initiate a feeding operation when said storage means and said feeding means reach a predetermined relative position, and for initiating a timer so that in the event that said detecting means does not detect a sheet within a predetermined period of time after initiation of the feeding operation of said feeding means, said control means stops the feeding operation of said feeding means at the expiration of the predetermined period of time.

18. An apparatus according to claim 17, wherein the predetermined input signal is a signal for returning said storage means to a home position, and the predetermined relative position is a position where said storage means is in the home position.

19. A sheet handling apparatus comprising:

storage means having a plurality of storage sections for storing sheets transferred from an image forming apparatus;

feeding means for feeding the sheets to said storage means;

moving means for moving said storage means and said feeding means relative to each other;

first detecting means for detecting that said storage means and said feeding means are in a predetermined relative position;

second detecting means for detecting that the relative movement of said storage means and said feeding means has been effected by said moving means; and diagnosis means for designating the operation of the sheet handling apparatus as abnormal in the event that said second detecting means detects that relative movement to a relative position different from said predetermined relative position has been effected by said moving means and said first detecting means detects that said storage means and said feeding means are in the predetermined relative position.

20. An apparatus according to claim 19, wherein the predetermined relative position is a home position of said storage means.

* * * * *

UNITED STATES PATENT AND TRADEMARK OFFICE

CERTIFICATE OF CORRECTION

PATENT NO. : 4,738,443 Sheet 1 of 3

DATED : April 19, 1988

INVENTOR(S) : TAKESHI HONJO, ET AL.

It is certified that error appears in the above-identified patent and that said Letters Patent is hereby corrected as shown below:

In the Headnote;

[56], "Cross" should read --Cross, et al.--;
, "Hannigan" should read --Hannigan, et al.--
"Miyashita" should read --Miyashita, et al.--.

Column 1, line 26, "stored and stored" should read --sorted and stored--;

line 55, "(switch)and" should read --(switch) and--.

Column 2, line 8, "ar" should read --are--.

Column 4, line 53, "leads" should read --lead--.

Column 5, line 27, "6b ," should read --6b,--.

Column 7, lines 43-44, delete "and an output from the inverter Q48 is at "L" level".

UNITED STATES PATENT AND TRADEMARK OFFICE

CERTIFICATE OF CORRECTION

PATENT NO. : 4,738,443 Sheet 2 of 3

DATED : April 19, 1988

INVENTOR(S) : TAKESHI HONJO, ET AL.

It is certified that error appears in the above-identified patent and that said Letters Patent is hereby corrected as shown below:

Column 8, line 56, "S700" should read --700--.

Column 11, line 10, "equal" should read --equal to--;

line 41, "that" should read --that predetermined for--.

Column 13, line 20, "bin" should read --in--;

line 32, "a" should read --as--;

line 35, "determine" should read --determine if--.

Column 14, line 17, "an" should read --and--;

line 18, "a" should read --an--;

line 43, "sheets" should read --sheet--;

line 49, "storing" should read --storage--.

UNITED STATES PATENT AND TRADEMARK OFFICE

CERTIFICATE OF CORRECTION

PATENT NO. : 4,738,443 Sheet 3 of 3

DATED : April 19, 1988

INVENTOR(S) : TAKESHI HONJO, ET AL.

It is certified that error appears in the above-identified patent and that said Letters Patent is hereby corrected as shown below:

Column 15, line 55, "connected" should read --connectable--;

line 61, "storate" should read --storage--.

Signed and Sealed this

Sixth Day of September, 1988

*Attest:*

DONALD J. QUIGG

*Attesting Officer*

*Commissioner of Patents and Trademarks*